US005313216A

United States Patent [19]

Wang et al.

[11] Patent Number: 5,313,216

[45] Date of Patent: May 17, 1994

[54] MULTIOCTAVE MICROSTRIP ANTENNA

[75] Inventors: Johnson J. H. Wang, Marietta; Victor K. Tripp, Tucker, both of Ga.

[73] Assignee: Georgia Tech Research Corporation, Atlanta, Ga.

[21] Appl. No.: 962,029

[22] Filed: Oct. 15, 1992

Related U.S. Application Data

[63] Continuation of Ser. No. 695,686, May 3, 1991, abandoned.

[51] Int. Cl.[5] ..... H01Q 1/380; H01Q 11/080; H01Q 11/100

[52] U.S. Cl. ..... 343/700 MS; 343/792.5; 343/895

[58] Field of Search ..... 343/700 MS, 895, 792.5, 343/846, 829; H01Q 1/38, 13/08, 11/08-11/16, 1/36

[56] References Cited

U.S. PATENT DOCUMENTS

| | | | |
|---|---|---|---|
| 4,085,406 | 4/1978 | Schmidt et al. | 343/895 |
| 4,204,212 | 5/1980 | Sindoris et al. | 343/700 MS |
| 4,608,572 | 8/1986 | Blakney et al. | 343/792.5 |
| 4,651,159 | 3/1987 | Ness | 343/700 MS |
| 4,658,262 | 4/1987 | Du Hamel | 343/895 |
| 4,772,890 | 9/1988 | Bowen et al. | 343/700 MS |
| 4,823,145 | 4/1989 | Mayes et al. | 343/895 |

FOREIGN PATENT DOCUMENTS

| | | | |
|---|---|---|---|
| 394960A | 10/1990 | European Pat. Off. | H01Q 9/4 |
| 1157600 | 5/1985 | U.S.S.R. | H01Q 11/08 |
| 1390514 | 4/1975 | United Kingdom | 343/895 |

OTHER PUBLICATIONS

Nakano et al., A Spiral Antenna Backed by a Conducting Plane Reflector, IEEE Trans. Ant. & Prop. vol. AP-34, No. 6, Jun. 1986, pp. 791-796.

Van de Capelle et al., Microstrip Spiral Antennas, AP-S Int. Symp. Dig., Ant. & Prop., vol. I, pp. 383-386.

Franks et al. Reflector-Type Periodic Broadband Antennas. 1958 IRE Wescon Convention Record, Pt. 1, vol. 2, Aug., 1958, pp. 266-271.

James et al. Some Recent Developments in Microstrip Antenna Design IEEE Trans. on Ant. & Prop., vol. AP-29 No. 1 Jan. 1981, pp. 124-128.

*Primary Examiner*—William Mintel
*Assistant Examiner*—Peter Toby Brown
*Attorney, Agent, or Firm*—Deveau, Colton & Marquis

[57] ABSTRACT

A multioctave microstrip antenna for mounting to one side of a ground plane and including a metal foil spiral-mode antenna element and a dielectric substrate positioned between the antenna element and the ground plane. The spiral-mode antenna element has a frequency-independent pattern formed therein, such as a sinuous, log-periodic, tooth, or spiral pattern. The antenna can be mounted substantially flushly to the surface of a structure without perforating the surface of the structure and can be conformed thereto. The antenna exhibits a broad bandwidth, typically on the order of 600%.

18 Claims, 7 Drawing Sheets

MULTIOCTAVE MICROSTRIP ANTENNA

This invention was made with Government support under a contract from the U.S. Air Force. The Government has certain rights in the invention.

This is a continuation of copending application Ser. No. 07/695,686 filed on May 3, 1991, now abandoned.

TECHNICAL FIELD

The present invention relates generally to antennas, and more particularly relates to microstrip antennas and to frequency-independent antennas.

BACKGROUND OF THE INVENTION

In many antenna applications, for example such as for use with military aircraft and vehicles, an antenna with a broad bandwidth is required. For such applications, the so-called "frequency-independent antenna" ("FI antenna") commonly has been employed. See for example, V. H. Rumsey, *Frequency Independent Antennas,* Academic Press, New York, N.Y., 1966. Such frequency-independent antennas typically have a radiating, or driven element with spiral, or log-periodic geometry that enables the FI antenna to transmit and receive signals over a wide band of frequencies, typically on the order of a 9:1 ratio or more (a bandwidth of 900%). European Patent Application No. 86301175.5 of R. H. DuHamel entitled "Dual Polarized Sinuous Antennas", published Oct. 22, 1986, publication No. 0198578, discloses frequency-independent antennas with sinuous structures.

In a frequency-independent antenna, a lossy cylindrical cavity is positioned to one side of the antenna element so that when transmitting, energy effectively is radiated outwardly from the antenna only from one side of the antenna element (the energy radiating from the other side of the antenna element being dissipated in the cavity). However, high-performance military aircraft, and other applications as well, require that the antenna be mounted substantially flush with its exterior surface, in this case the skin of the aircraft. This undesirably requires that the cavity portion of the FI antenna be mounted within the structure of the aircraft, necessitating that a substantial hole be formed therein to accommodate the cylindrical cavity, which typically is two inches deep and several inches in diameter for microwave frequencies. Also, the use of a lossy cavity to dissipate radiation causes half of the radiated power to be lost, requiring a greater power input to effect a given level of power radiated outwardly from the FI antenna.

In recent years the so-called "microstrip antenna" has been developed. See for example, U.S. Pat. No. 29,911 of Munson (a reissue of U.S. Pat. No. 3,921,177) and U.S. Pat. No. 29,296 of Krutsinoer, et al (a reissue of U.S. Pat. No. 3,810,183). In a typical microstrip antenna, a solid thin metal patch is placed adjacent to a ground plane and spaced a small distance therefrom by a dielectric spacer. Microstrip antennas have generally suffered from having a narrow useful bandwidth, typically less than 10%. At least one researcher has made preliminary investigations into using a single microstrip line wound as an Archimedean spiral (C. Wood, "Curved Microstrip Lines as Compact Wideband Circularly Polarized Antennas", published in Inst. Elec. Eng. Microwaves, Optics and Acoustics, Vol. 3, pp. 5-13, January 1979). That researcher concluded, however, that the achievement of a microstrip-type antenna with a wide bandwidth analogous to the conventional spiral (of a frequency-independent antenna) was not feasible because the radiation patterns of the contemplated low-profile antenna tend to exhibit a large axial ratio.

Accordingly, it can be seen that a need yet remains for an antenna which has the dimensional characteristics of a microstrip antenna, i.e., has a low-profile, and has a broad bandwidth similar to a frequency-independent antenna. It is to the provision of such an antenna, therefore, that the present invention is primarily directed.

SUMMARY OF THE INVENTION

Briefly described, in a preferred form the present invention comprises a multioctave microstrip antenna for mounting to one side of a ground plane or other surface, the antenna comprising a spiral-mode antenna element, as will be defined in more detail below, having a peripheral portion, a substrate positioned to one side of the antenna element for spacing the antenna element a selected distance from the ground plane, the substrate having a low dielectric constant, and a loading material positioned adjacent to the peripheral portion of the antenna element. Preferably, the antenna element comprises a thin metal foil having a frequency-independent pattern formed therein, such as a sinuous, log-periodic, tooth, or spiral pattern. Preferably, the substrate has a dielectric constant of between 1 and 4.5. Also, the thickness of the substrate is carefully selected to get near maximum gain at a particular wavelength, with the substrate having a thickness of between 0.05 and 0.3 wavelength in the substrate material, typically in the range of 0.1 to 0.30 inches for microwave frequencies (2 to 18 GHz).

With this construction, an antenna is provided which can be mounted externally to a structure without perforating the surface of the structure and which can be conformed to the surface. Also, the antenna exhibits a broad bandwidth, typically on the order of 600%. This design is based on the discovery by the applicants that the ground plane of a microstrip antenna is compatible with the spiral modes of the frequency-independent antenna. Poor radiation patterns which might be expected due to a small amount of residual power after the electric current on the spiral has passed through the first-mode active region (which is positioned at a ring about one wavelength in circumference) can be avoided by removing the residual power from the radiation. This is the function of the loading material positioned adjacent to the peripheral portion of the antenna element.

Accordingly, it is a primary object of the present invention to provide an antenna which has the broad bandwidth performance similar to a frequency-independent antenna, while having a low profile of a microstrip antenna.

It is another object of the present invention to provide a microstrip antenna which has an improved bandwidth.

It is another object of the present invention to provide a microstrip antenna which has a bandwidth approaching that of prior frequency-independent antennas.

It is another object of the present invention to provide an antenna which has the bandwidth performance similar to a frequency-independent antenna, but which requires less input power to provide a given level of radiated power.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

The Physical Structure

Figure 1:
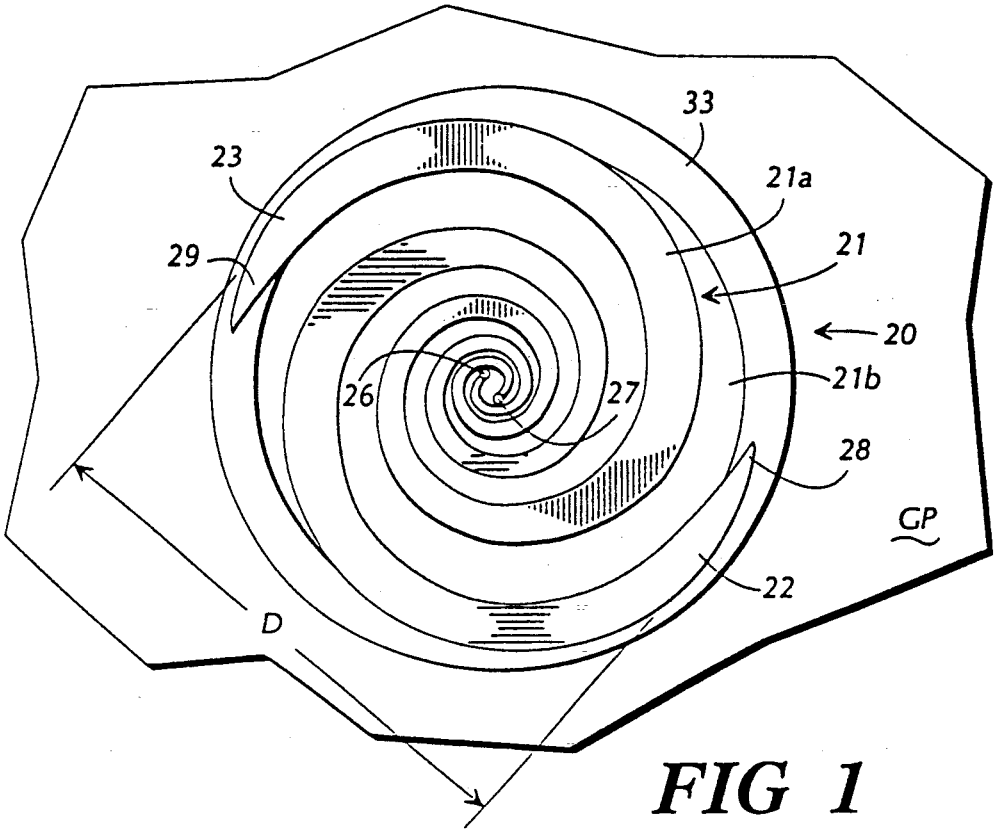
FIG. 1 is a plan view of a multioctave spiral mode microstrip antenna in a preferred form of the invention.
Figure 2A:
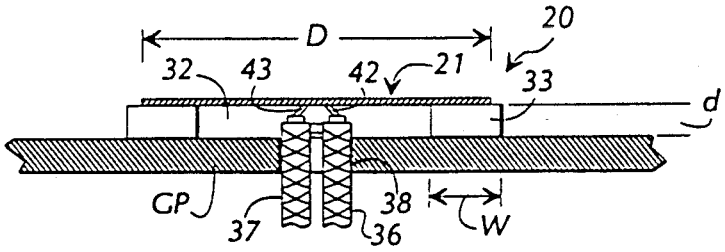
FIG. 2A is a schematic, partially sectional side view of the antenna of FIG. 1.
Figure 2B:
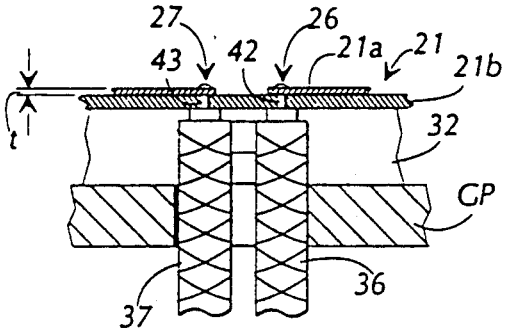
FIG. 2B is a schematic, partially sectional side view of a portion of the antenna of FIG. 2A.

Referring now in detail to the drawing figures, wherein like reference characters represent like parts throughout the several views, FIGS. 1, 2A and 2B show a multioctave microstrip antenna 20, according to a preferred form of the invention and shown with its ground plane GP. The antenna 20 includes an antenna element 21 comprising a very thin metal foil 21*a*, preferably copper foil, and a thin dielectric backing 21*b*. The antenna element foil 21*a* shown in FIGS. 1, 2A and 2B has a spiral shape or pattern including first and second spiral arms 22 and 23. Spiral arms 22 and 23 originate at terminals 26 and 27 roughly at the center of antenna element 21. The spiral arms 22 and 23 spiral outwardly from the terminals 26 and 27 about each other and terminate at tapered ends 28 and 29, thereby roughly defining a circle having a diameter D and a corresponding circumference of $\pi D$. The antenna element foil 21*a* is formed from a thin metal foil or sheet of copper by any of well known means, such as by machining, stamping, chemical etching, etc. Antenna element foil 21*a* has a thickness t of less than 10 mils or so, although other thicknesses obviously can be employed as long as it is thin in terms of the wavelength, say for example, 0.01 wavelength or less. While the invention is disclosed herein in connection with a ground plane GP, it will be obvious to those skilled in the art that the antenna can be constructed without its own ground plane, making the antenna suitable for mounting on conducting surfaces, e.g., metal vehicles.

The thin antenna element 21 is flexible enough to be mounted to contoured shapes of the ground plane, although in FIGS. 2A and 2B the ground plane is represented as being truly planar. The antenna element foil 21*a* is uniformly spaced a selected distance d (the standoff distance) from the ground plane GP by a dielectric spacer 32 positioned between the antenna element 21 and the ground plane GP. The dielectric spacer 32 preferably has a low dielectric constant, in the range of 1 to 4.5, as will be discussed in more detail below. The dielectric spacer 32 is generally in the form of a disk and is sized to be slightly smaller in diameter than the antenna element 21. The thickness d of the dielectric spacer 32 typically is much greater than the thickness of the dielectric backing 21*b* of the antenna element 21. The thickness d of spacer 32 typically is in the neighborhood of 0.25" for microwave frequencies. However, the specific thickness chosen to provide a reasonable gain for a given frequency should be less than one-half of the wavelength of the frequency in the medium of the dielectric spacer.

A loading 33 comprising a microwave absorbing material, such as carbon-impregnated foam, in the shape of a ring is positioned concentrically about dielectric spacer 32 and extends partially beneath antenna element 21. Alternatively, a paint laden with carbon can be applied to the outer edge of the antenna element. Also, the antenna element can be provided with a peripheral shorting ring positioned adjacent and just outside the spiral arms 22 and 23 and the peripheral shorting ring (unshown) can be painted with the carbon-laden paint.

First and second coaxial cables 36 and 37 extend through an opening 38 in the ground plane GP for electrically coupling the antenna element 21 with a feed source, driver or detector. The coax cables 36 and 37 include central shielded electric cables 42 and 43 which are respectively connected with the terminals 26 and 27. The outer shieldings of the coaxial cables 36 and 37 are electrically coupled to each other in the vicinity of the antenna element, as shown in FIG. 2B. As shown schematically in FIG. 3, this electrical coupling of the shielding of the coaxial cables can be accomplished by soldering a short electric cable 44 at its ends to each of the coaxial cables 36 and 37.

Figure 3:
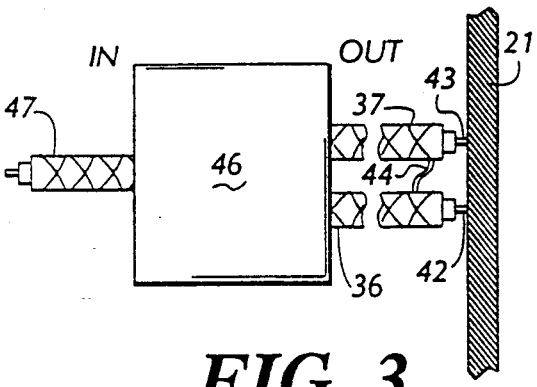
FIG. 3 is a schematic view of a feed for driving the antenna of FIG. 1.

Preferably, as shown in FIG. 3, the coaxial cables 36 and 37 are connected to a conventional RF hybrid unit 46 which is in turn connected with a single coax cable input 47. The function of the RF hybrid unit 46 is to take a signal carried on the input coax cable 47 and split it into two signals, with one of the signals being phase-shifted 180° relative to the other signal. The phase-shifted signals are then sent out through the coaxial cables 36 and 37 to the antenna element 21. By providing two signals, phase-shifted 180° relative to each other, to the two antenna element arms, a voltage potential is developed across the terminals 26 and 27 corresponding to the waveform carried along the coaxial cables 36, 37 and 47, causing the antenna to radiate primarily in a n=1 mode (although some components of higher-order modes can be present). As an alternative, a balun may be used to split the input signal into first and second signals, with one of the signals being delayed relative to the other. A balun can be used to feed the antenna for operating in the n=1 mode (axial beam pattern). The RF hybrid circuit can be used for generating higher-order modes, e.g., n=2. For generating these higher-order modes, 4, 6, or 8 antenna element arms are used in conjunction with a corresponding number of feed terminals.

Figure 4A:
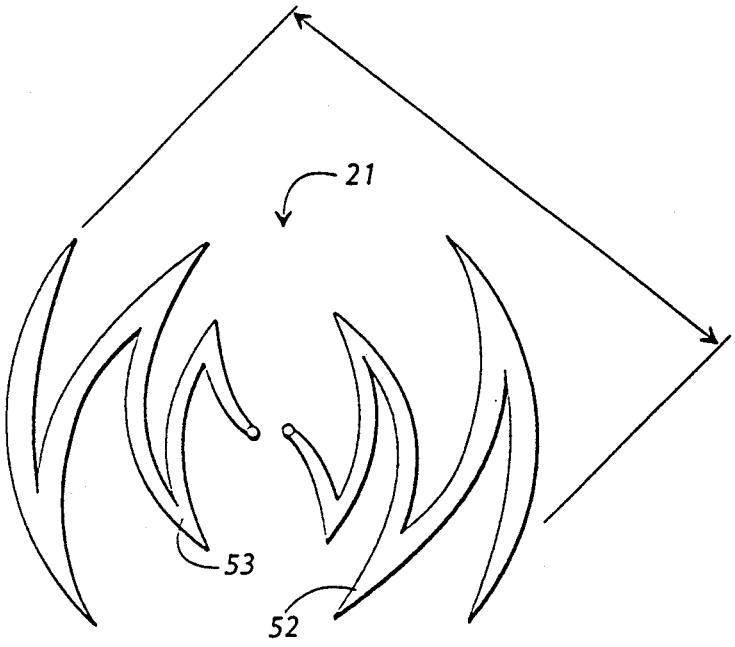
FIGS. 4A and 4B are plan views of modified forms of the antenna of FIG. 1, depicting sinuous antenna elements.
Figure 4B:
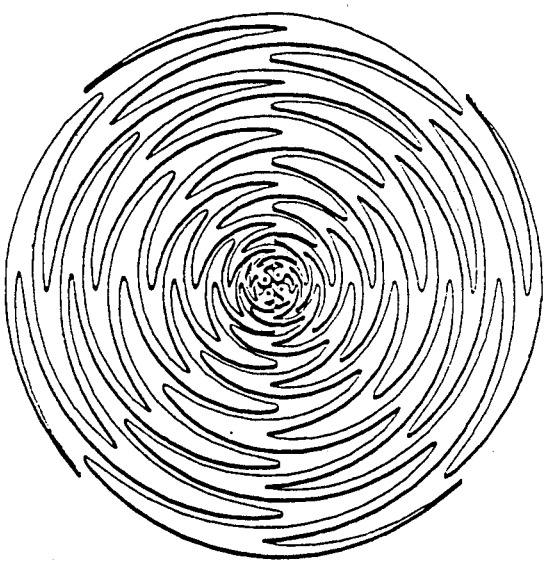

FIG. 4A shows an alternative embodiment of the antenna of FIG. 1, with the spiral arms 22 and 23 of FIG. 1 being replaced with sinuous arms 52 and 53. While a two-arm sinuous antenna element is shown in FIG. 4A, a four-arm sinuous antenna element can be provided if higher-order modes are desired, as shown in FIG. 4B.

Figure 5A:
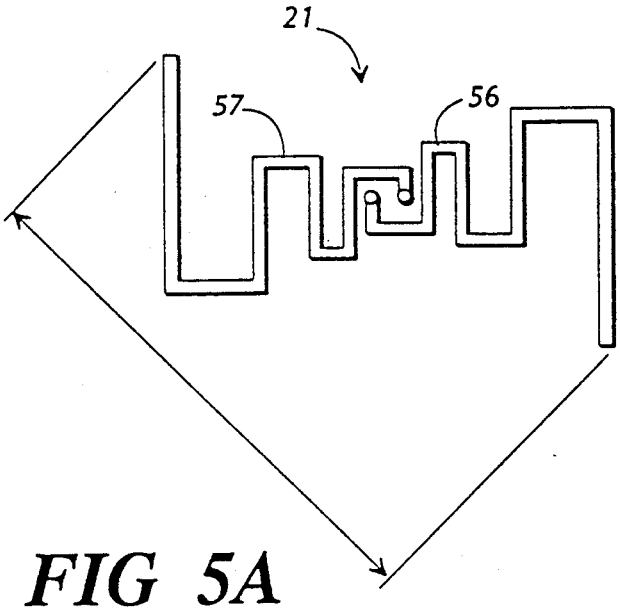
FIGS. 5A and 5B are plan views of modified forms of the antenna of FIG. 1, depicting log-periodic tooth antenna elements.
Figure 5B:
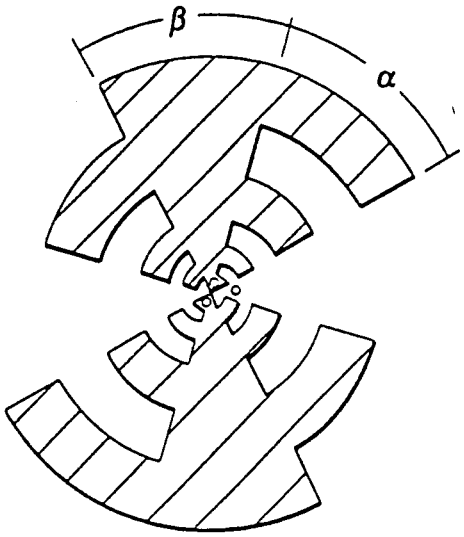

FIG. 5A shows a modified form of the antenna element 21 in which the spiral arms 22 and 23 are replaced with log-periodic meander-line arms 56 and 57. The toothed antenna element illustratively shown in FIG. 5A includes toothed arms which have linear segments which are perpendicular to each other, i.e., the "teeth" of each arm are generally rectangular. Alternatively, the teeth can be smoothly contoured to eliminate the sharp corners at each tooth. Also, the teeth can curved as shown in FIG. 5B.

Figure 6:
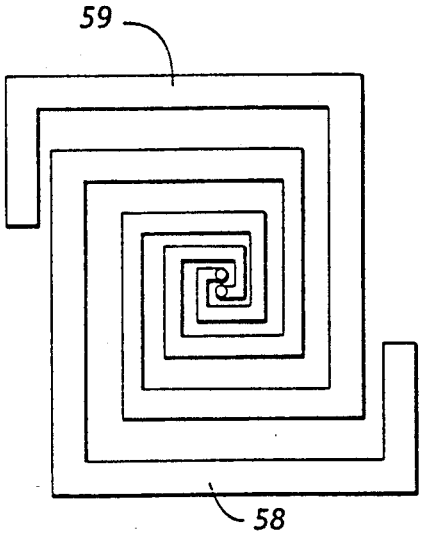
FIG. 6 is a plan view of a modified form of the antenna of FIG. 1, depicting a "Greek spiral" or a rectangular log spiral antenna element.
Figure 7:
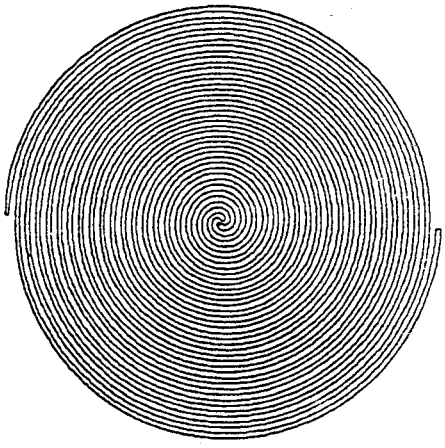
FIGS. 7 and 8 are plan views of modified forms of the antenna of FIG. 1, depicting Archimedean and equiangular spiral antenna elements, respectively.
Figure 8:
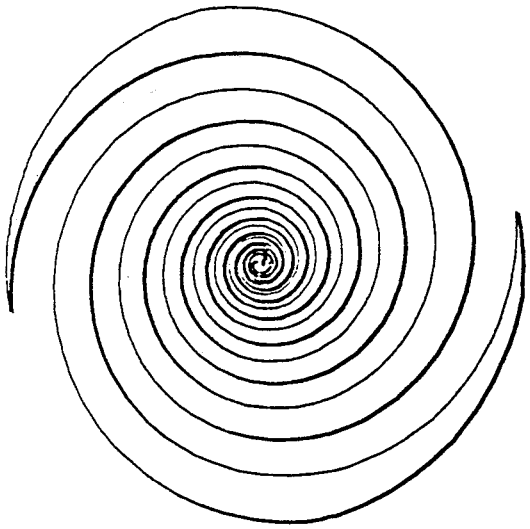

FIG. 6 shows another modified form of the antenna element of FIG. 1 in which the spiral arms 22 and 23 are replaced with "Greek spiral" arms 58 and 59. Each of the Greek spiral arms is in the form of a spiraling square, as compared with the rounded spiral of the antenna element of FIG. 1. FIGS. 7 and 8 show that the spiral pattern of FIG. 1 can be provided as an "Archimedean spiral" as shown in FIG. 7 or as an "equiangular spiral" as shown in FIG. 8.

Theoretical Basis of the Invention

The following discussion represents the results of a theoretical study by applicants establishing the viability of the invention. Experimental verification of the theoretical basis will be provided in the section immediately following this one.

The basic planar spiral antenna, which consists of a planar sheet of an infinitely large spiral structure, radiates on both sides of the spiral in a symmetric manner. When radiating in n=1 mode, most of the radiation occurs on a circular ring around the center of the spiral whose circumference is approximately one wavelength. As a result, one can truncate the spiral outside this active region without too much disruption to its pattern, or dissipative loss to its radiated power.

Figure 9A:
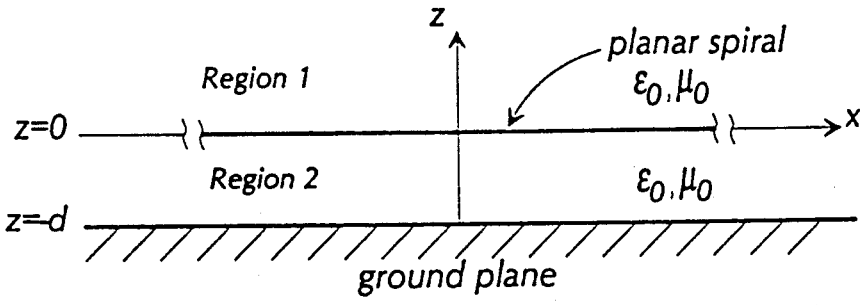
FIGS. 9A and 9B and 10A and 10B are schematic illustrations of mathematical models used to analyze the theoretical basis of the invention.
Figure 9B:
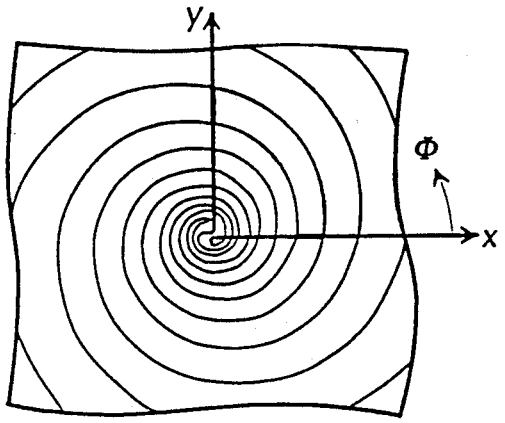

FIGS. 9A and 9B depict an infinite, planar spiral backed by a group plane. The spiral mode fields in Region 1 can be decomposed into TE and TM fields in terms of vector potentials $F_l$ and $A_l$ as follows:

$$F_l = \hat{z} F_l \Psi_l \text{ TE Solution} \tag{1}$$

$$A_l = \hat{z} A_l \Psi_l \text{ TM Solution} \tag{2}$$

In Region 1 where modes propagate in the +z direction, we have $$\Psi_l = e^{jn\phi} \int_0^\infty g(k_\rho) J_n(k_\rho \rho)\, e^{-jk_{zl} z}\, k_\rho dk_\rho \tag{3}$$

$$k_{zl} = [k_l^2 - k_\rho^2]^{\frac{1}{2}}$$

$$k_l = \omega (\epsilon_o \mu_o)^{\frac{1}{2}} \tag{4}$$

and the explicit expressions for the fields in the region 1, where l=1, are given by:

$$E_{\rho l} = \frac{A_l}{j\omega\epsilon_l} \frac{\partial^2 \Psi_l}{\partial\rho\partial z} - \frac{F_l}{\rho} \frac{\partial \Psi_l}{\partial\phi} = e^{jn\phi} \int_0^\infty g(k_\rho)\, e^{-jk_{zl} z} \left[ \frac{-A_l}{\omega\epsilon_o} k_\rho J_n'(k_\rho\rho) k_{zl} - \frac{F_l jn}{\rho} J_n(k_\rho\rho) \right] k_\rho dk_\rho \tag{5}$$

$$E_{\phi l} = \frac{A_l}{j\omega\epsilon_o\rho} \frac{\partial^2 \Psi_l}{\partial\phi\partial z} + F_l \frac{\partial \Psi_l}{\partial\rho} = e^{jn\phi} \int_0^\infty g(k_\rho)\, e^{-jk_{zl} z} \left[ \frac{A_l n k_{zl}}{j\omega\epsilon_o\rho} J_n(k_\rho\rho) + F_l k_\rho J_n'(k_\rho\rho) \right] k_\rho dk_\rho \tag{6}$$

$$E_{zl} = \frac{A_l}{j\omega\epsilon_o} \left( \frac{\partial^2}{\partial z^2} + k_l^2 \right) \Psi_l = \frac{A_l}{j\omega\epsilon_o} \int_0^\infty g(k_\rho)\, e^{-jk_{zl} z} [-k_{lz}^2 + k_l^2] J_n(k_\rho\rho) k_\rho dk_\rho \tag{7}$$

$$H_{\rho l} = \frac{A_l}{\rho} \frac{\partial \Psi_l}{\partial\phi} + \frac{F_l}{j\omega\mu_l} \frac{\partial^2 \Psi_l}{\partial\rho\partial z} = e^{jn\phi} \int_0^\infty g(k_\rho)\, e^{-jk_{zl} z} \left[ \frac{A_l jn}{\rho} J_n(k_\rho\rho) - \frac{F_l k_{zl} k_\rho}{\omega\mu_l} J_n'(k_\rho\rho) \right] k_\rho dk_\rho \tag{8}$$

$$H_{\phi l} = -A_l \frac{\partial \Psi_l}{\partial\rho} + \frac{F_l}{j\omega\mu_l\rho} \frac{\partial^2 \Psi_l}{\partial\phi\partial z} = e^{jn\phi} \int_0^\infty g(k_\rho)\, e^{-jk_{zl} z} \left[ -A_l k_\rho J_n'(k_\rho\rho) - \frac{F_l n k_{zl}}{j\omega\mu_l\rho} J_n(k_\rho\rho) \right] k_\rho dk_\rho \tag{9}$$

$$H_{zl} = \frac{F_l}{j\omega\mu_l} \left( \frac{\partial^2}{\partial z^2} + k_l^2 \right) \Psi_l = \frac{F_l}{j\omega\mu_l} e^{jn\phi} \int_0^\infty g(k_\rho)\, e^{-jk_{zl} z} [-k_{zl}^2 + k_l^2] J_n(k_\rho\rho) k_\rho dk_\rho \tag{10}$$

In Region 2, modes propagating in both +z and −z directions exist and therefore the vector potentials are $$F_2^{\pm} = \hat{z} F_2^{\pm} \Psi_2^{\pm} \quad \text{TE solution} \tag{11}$$

$$A_2^{\pm} = \hat{z} A_2^{\pm} \Psi_2^{\pm} \quad \text{TM solution} \tag{12}$$

where $$\Psi_2^{\pm} = e^{jn\phi} \int_0^\infty g(k_\rho) J_n(k_\rho\rho)\, e^{\mp jk_{zz} z}\, k_\rho dk_\rho \tag{13}$$

The explicit expressions for the fields in Region 2 are as follows:

$$E_{\rho 2} = e^{jn\phi}\int_0^\infty g(k_\rho)[-A_2^+ e^{-jkz} + A_2^- e^{jkz}]\frac{k_z k_\rho^2}{\omega\epsilon_o} J_n'(k_\rho\rho)dk_\rho + e^{jn\phi}\int_0^\infty g(k_\rho)[-F_2^+ e^{-jkz} - F_2^- e^{jkz}]\frac{jnk_\rho}{\rho} J_n(k_\rho\rho)\, dk_\rho \tag{14}$$

$$E_{\phi 2} = e^{jn\phi}\int_0^\infty g(k_\rho)[A_2^+ e^{-jkz} - A_2^- e^{jkz}]\frac{nk_z k_\rho}{j\omega\epsilon_o\rho} J_n(k_\rho\rho)dk_\rho + e^{jn\phi}\int_0^\infty g(k_\rho)[F_2^+ e^{-jkz} + F_2^- e^{jkz}]k_\rho^2 J_n'(k_\rho\rho)dk_\rho \tag{15}$$

$$E_{z2} = \frac{1}{j\omega\epsilon_o}\int_0^\infty g(k_\rho)J_n(k_\rho\rho)[A_2^+ e^{-jkz} + A_2^- e^{jkz}]k_\rho^3 dk_\rho \tag{16}$$

$$H_{\rho 2} = e^{jn\phi}\int_0^\infty g(k_\rho)[A_2^+ e^{-jkz} + A_2^- e^{jkz}]\frac{jnk_\rho}{\rho} J_n(k_\rho\rho)dk_\rho + e^{jn\phi}\int_0^\infty g(k_\rho)[-F_2^+ e^{-jkz} + F_2^- e^{jkz}]\frac{k_z k_\rho^2}{\omega\mu_o} J_n'(k_\rho\rho)dk_\rho \tag{17}$$

$$H_{\phi 2} = e^{jn\phi}\int_0^\infty g(k_\rho)[-A_2^+ e^{-jkz} - A_2^- e^{jkz}]k_\rho^2 J_n'(k_\rho\rho)dk_\rho + e^{jn\phi}\int_0^\infty g(k_\rho)[+F_2^+ e^{-jkz} - F_2^- e^{jkz}]\frac{nk_z k_\rho}{j\omega\mu_o\rho} J_n(k_\rho\rho)dk_\rho \tag{18}$$

$$H_{z2} = \frac{1}{j\omega\mu_o}\int_0^\infty g(k_\rho)J_n(k_\rho\rho)[F_2^+ e^{-jkz} + F_2^- e^{jkz}]k_\rho^3 dk_\rho \tag{19}$$

By matching the boundary conditions at $z=0$ (where tangential E and H are continuous in the aperture region) and $z=-d$ (where tangential E vanishes) and by requiring the fields satisfy the impedance conditions $$E_1 = j\eta H_1,\ E_2^+ = j\eta H_2^+,\ E_2^- = -j\eta H_2^- \tag{20}$$

we obtain the necessary and sufficient conditions for the spiral modes as follows:

$$\begin{aligned}
&A_1 = A_2^+ - A_2^- \\
&F_1 = F_2^+ + F_2^- \\
&-A_2^+ e^{jkzd} + A_2^- e^{-jkzd} = 0 \\
&F_2^+ e^{jkzd} + A_2^- e^{-jkzd} = 0 \\
&F_1 = -j\eta A_1 \\
&F_2^+ = -j\eta A_2^+ \\
&F_2^- = j\eta A_2^-
\end{aligned} \tag{21}$$

There are six unknowns in the above seven equations. However, the seven equations are not totally independent, and can be reduced to the following five independent equations.

$$\begin{aligned}
&F_1 = F_2^+ + F_2^- \\
&F_2^+ e^{jkzd} + F_2^- e^{-jkzd} = 0 \\
&F_1 = -j\eta A_1 \\
&F_2^+ = -j\eta A_2^+ \\
&F_2^- = j\eta A_2^-
\end{aligned} \tag{22}$$

Equations (22) have six parameters in the five equations. Let, say $A_1$, be given, then we can solve for all the other five parameters. Thus the spiral radiation modes can be supported by the structure of an infinite planar spiral backed by a ground plane as shown in FIG. 1. This finding is the design basis of the multioctave spiral-mode microstrip antennas disclosed herein.

In practice, the spiral is truncated. The residual current on the spiral beyond the mode-1 active region, therefore, faces a discontinuity where the energy is diffracted and reflected. The diffracted and reflected power due to the truncation of the spiral, as well as possible mode impurity at the feed point, is believed to degrade the radiation pattern. Indeed, this is consistent with what we have observed.

Figure 10A:
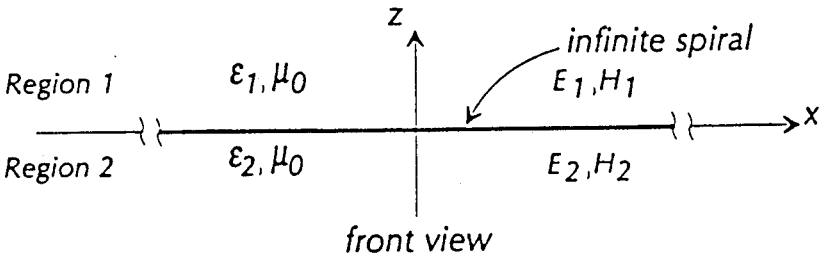
Figure 10B:
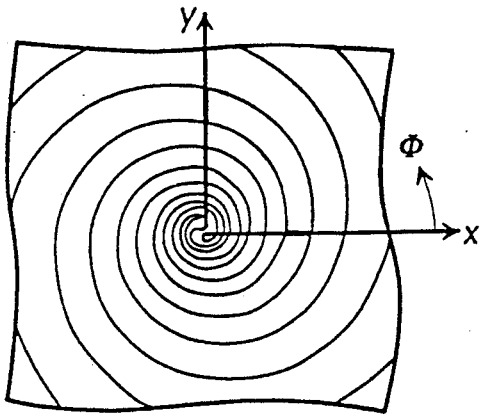

To examine the effect of a dielectric substrate on the spiral microstrip antenna, we study the simpler problem of an infinite spiral between two media, as shown in FIGS. 10A and 10B.

Region 1 is usually free space ($\epsilon_1=\epsilon_0$) where radiation is desired, Region 2 is an infinite dielectric medium with $\epsilon_2$ and $\mu_0$. Following the method of Section I, we express the fields in both Regions 1 and Region 2 in terms of electric and magnetic vector potentials $F_l$ and $A_l$.

The explicit expressions for fields in Region l (l=1 or 2) are $$E_{\rho l} = \frac{A_l}{j\omega\epsilon_l}\frac{\partial^2\Psi_l}{\partial\rho\partial z} - \frac{F_l}{\rho}\frac{\partial\Psi_l}{\partial\phi} = e^{jn\phi}\int_0^\infty g(k_\rho)\, e^{-jk_{zl}z}\left[\frac{-A_l}{\omega\epsilon_l}k_\rho J_n'(k_\rho\rho)k_{zl} - \frac{Fjn}{\rho}J_n(k_\rho\rho)\right]k_\rho dk_\rho \tag{23}$$

$$E_{\phi l} = \frac{A_l}{j\omega\epsilon_l\rho}\frac{\partial^2\Psi_l}{\partial\phi\partial z} + F_l\frac{\partial\Psi_l}{\partial\rho} = e^{jn\phi}\int_0^\infty g(k_\rho)\, e^{-jk_{zl}z}\left[\frac{A_l n k_{zl}}{j\omega\epsilon_l\rho}J_n(k_\rho\rho) + F_l k_\rho J_n'(k_\rho\rho)\right]k_\rho dk_\rho \tag{24}$$

$$E_{zl} = \frac{A_l}{j\omega\epsilon_l}\left(\frac{\partial^2}{\partial z^2} + k_l^2\right)\Psi_l = \frac{A_l}{j\omega\epsilon_l}\int_0^\infty g(k_\rho)\, e^{-jk_{zl}z}[-k_{lz}^2 + k_l^2]J_n(k_\rho\rho)k_\rho dk_\rho \tag{25}$$

$$H_{\rho l} = \frac{A_l}{\rho}\frac{\partial\Psi_l}{\partial\phi} + \frac{F_l}{j\omega\mu_l\rho}\frac{\partial^2\Psi_l}{\partial\rho\partial z} = e^{jn\phi}\int_0^\infty g(k_\rho)\, e^{-jk_{zl}z}\left[\frac{A_l jn}{\rho}J_n(k_\rho\rho) - \frac{F_l k_{zl}k_\rho}{\omega\mu_l}J_n'(k_\rho\rho)\right]k_\rho dk_\rho \tag{26}$$

$$H_{\phi l} = -A_l\frac{\partial\Psi_l}{\partial\rho} + \frac{F_l}{j\omega\mu_l\rho}\frac{\partial^2\Psi_l}{\partial\phi\partial z} = \tag{27}$$

-continued $$e^{jn\phi}\int_{o}^{\infty} g(k_\rho)\, e^{-jk_{zl}z}\left[-A_l k_\rho J_n'(k_\rho\rho) - \frac{F_l n k_{zl}}{j\omega\mu_l\rho} J_n(k_\rho\rho)\right]k_\rho dk_\rho \tag{28}$$

$$H_{zl} = \frac{F_l}{j\omega\mu_l}\left(\frac{\partial^2}{\partial z^2} + k_l^2\right)\Psi_l =$$

$$\frac{F_l}{j\omega\mu_l} e^{jn\phi}\int_{o}^{\infty} g(k_\rho)\, e^{-jk_{zl}z}\,[-k_{zl}^2 + k_l^2]J_n(k_\rho\rho)k_\rho dk_\rho$$

Continuity of the tangential E field at z=0 in the aperture region requires $$\frac{-A_1}{\omega\epsilon_1} k_\rho k_{z1} = \frac{A_2 k_{z2} k_\rho}{\omega\epsilon_2}$$

$$\frac{F_1 jn}{\rho} = \frac{F_2 jn}{\rho}$$

$$\frac{A_1 n k_{z1}}{j\omega\epsilon_1\rho} = \frac{-A_2 n k_{z2}}{j\omega\epsilon_2\rho}$$

$$F_1 k_\rho = F_2 k_\rho \tag{29}$$

Eq. (29) can be reduced to $$\frac{-A_1 k_{z1}}{\epsilon_1} = \frac{A_2 k_{z2}}{\epsilon_2}$$

$$F_1 = F_2 \tag{30}$$

The impedance condition $$E_1 = j\eta_1 H_1 \tag{31}$$

requires $$\frac{A_1}{\epsilon_1} = \frac{j\eta_1 F_1}{\mu_1}$$

$$-F_1 = j\eta_1 A_1 \tag{32}$$

which can be reduced to $$F_1 = -j\eta_1 A_1 \tag{33}$$

Similarly, $$E_2 = -j\eta_2 H_2 \tag{34}$$

requires $$F_2 = j\eta_2 A_2 \tag{35}$$

Eqs. (30), (34) and (35) are constraints on $A_1$, $F_1$, $F_2$, $A_2$, which we summarize as follows:

$$\frac{-A_1 k_{z1}}{\epsilon_1} = \frac{A_2 k_{z2}}{\epsilon_2}$$

$$F_1 = F_2$$

$$F_1 = -j\eta_1 A_1$$

$$F_2 = j\eta_2 A_2 \tag{36}$$

The four equations in (36) can not be satisfied simultaneously unless $$\frac{\eta_1\epsilon_1}{k_{z1}} = \frac{\eta_2\epsilon_2}{k_{z2}} \tag{37}$$

or $$\frac{k_1}{k_{z1}} = \frac{k_2}{k_{z2}} \tag{38}$$

or $$\left[1 - \left(\frac{k_\rho}{k_1}\right)^2\right]^{\frac{1}{2}} = \left[1 - \left(\frac{k_\rho}{k_2}\right)^2\right]^{\frac{1}{2}}. \tag{39}$$

We seem that Eq. (39) can be satisfied only if $$k_1 = k_2 \text{ or } \epsilon_1 = \epsilon_2 \tag{40}$$

This means that the n=1 spiral mode cannot be supported by the dielectric-backed spiral shown in FIG. 2 without significant components of higher-order modes. This finding explains why earlier efforts to design a broadband spiral microstrip antenna failed.

Experimental Results Verifying the Theoretical Basis of the Invention

The effect of the presence of high-dielectric-constant material on the performance of the antenna was studied in two ways: with and without a ground plane. To investigate the case of no ground plane, both calculations and measurements were used. The basic conclusion was that patterns degrade in the presence of a dielectric substrate; the higher the dielectric constant, and the thicker the substrate, the more seriously the patterns degrade. Even though dielectric substrates cause pattern degradation, it is possible to design spiral microstrip antennas with acceptable performance over a narrower frequency band.

The case of dielectric substrates between the spiral and the ground plane was studied for materials of relatively small dielectric constant, the greatest being 4.37, and little degregation was found at these frequencies. The studies were conducted using the configuration of FIG. 1 with a substrate of 0.063 inches of fiberglass, and for a substrate of 0.145 inches of air. In both of these configurations, the electrical spacing is the same (within 10%).

Figure 11A:
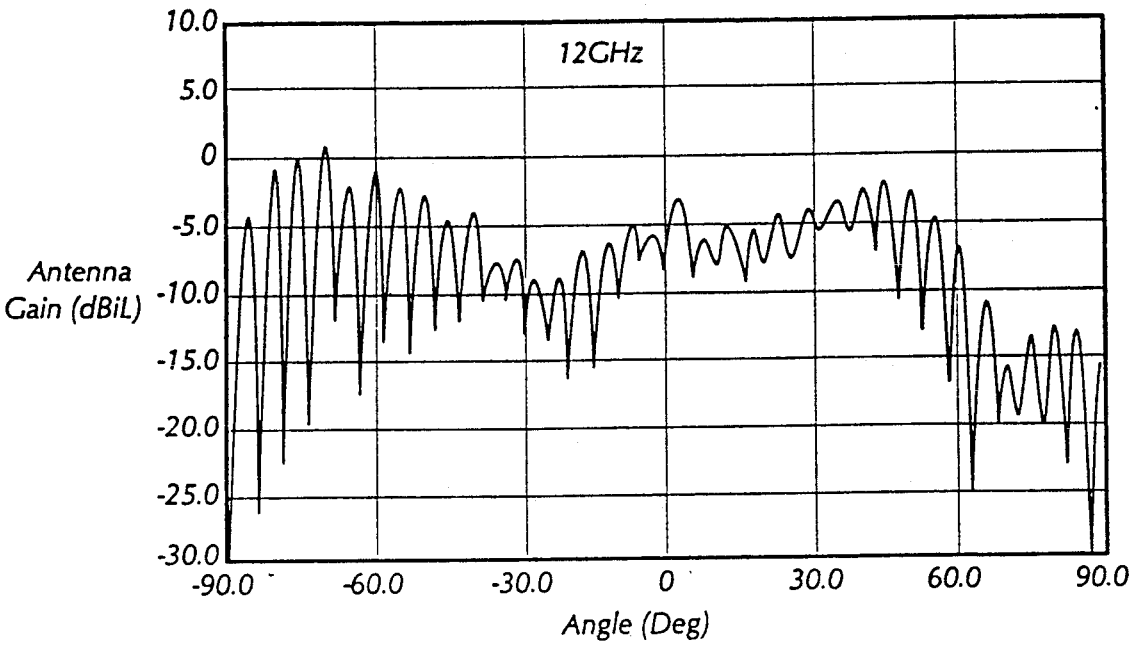
FIGS. 11A and 11B are graphs of experimental laboratory results of the disruptive effect of the dielectric substrate (when the dielectric constant is great) on the radiation pattern of an antenna according to the present invention.
Figure 11B:
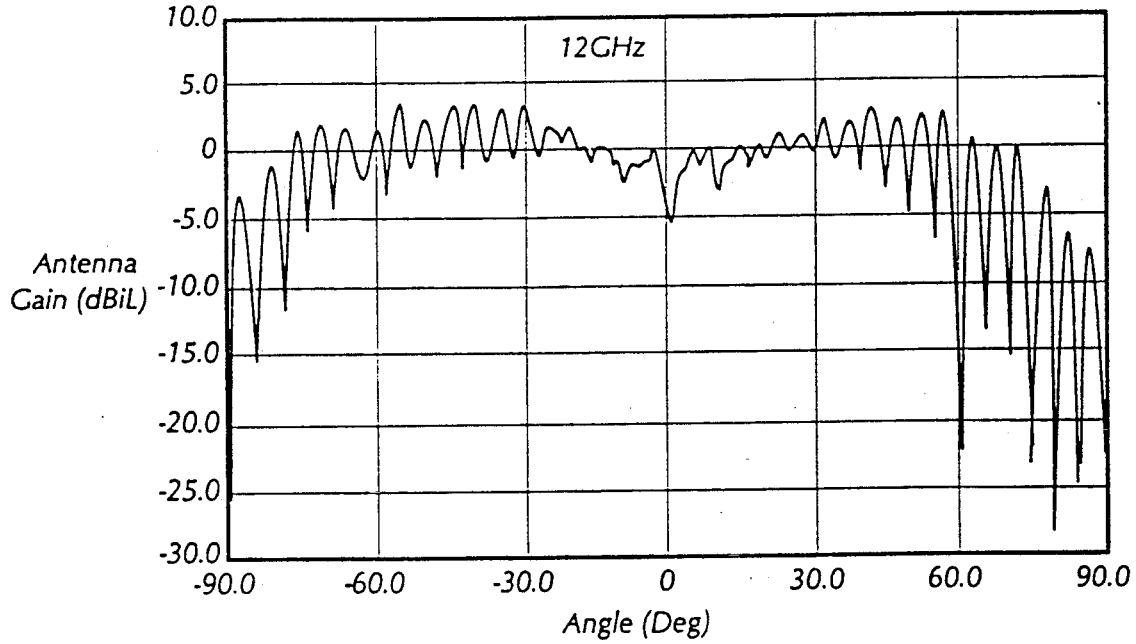

On the other hand, FIGS. 11A and 11B show some disruptive effect on the mode-1 radiation patterns at 9 and 12 GHz for an antenna with $\epsilon_r$=4.37 (fiberglass) and a substrate thickness of d=1/16 inch. When the substrate thickness d is reduced to 1/32 inch, the effect of the dielectric becomes larger, especially at lower frequencies. However, VSWR (voltage standing-wave ratio) remains virtually unaffected by the presence of the dielectric. We have thus demonstrated, both theoretically and experimentally, the disruptive effect of dielectric substrates on antenna patterns.

In many practical applications, the spiral microstrip antenna is to be mounted on a curved surface. To examine the effect of conformal mounting of the spiral microstrip antenna on a curved surface, we placed a 3-inch diameter spiral microstrip antenna on a half-cylinder shell with a radius of 6 inches and a length of 14 inches. The truncated spiral was placed 0.3-inch above and conformal to the surface of the cylinder with a styrofoam spacer. A 0.5 inch-wide ring of microwave absorbing material was placed at the end of the truncated spiral, with half of the absorbing material lying inside the spiral region and half outside it. The ring of absorbing material was 0.3-inch thick, thus filling the gap between the spiral antenna element and the cylinder surface.

The VSWR measurement of the spiral microstrip antenna conformally mounted on the half-cylinder shell was below 1.5 between 3.6 GHz and 12.0 GHz, and was below 2.0 between 2.8 GHz and 16.5 GHz. Thus, a 330% bandwidth was achieved for VSWR of 1.5 or lower, and a 590% bandwidth for VSWR of 2.0 or lower was reached.

The measured radiation patterns over $\theta$ on the y-z principal plane with $\phi=90°$ yielded good rotating-linear patterns obtained over a wide frequency bandwidth of 2–10 GHz. Measured radiation patterns on the x-z principal plane ($\phi=0°$) over $\theta$ are of the same quality. Thus, the spiral-mode microstrip antenna can be conformally mounted on a curved surface with little degradation in performance for the range of radius of curvature studied here.

Recently, a researcher has reported a theoretical analysis which indicated that poor radiation patterns are due to the residual power after the electric current on spiral wires (not "complementary") has passed through the first-mode radiation zone which is on a centered ring about one wavelength in circumference. (H. Nakano et al., "A Spiral Antenna Backed by a Conducting Plane Reflector", IEEE Trans. Ant. Prop., Vol. AP-34, pp. 791–796 (1986)). Thus, if one can remove the residual power from radiation, it should be possible to obtain excellent radiation patterns over a very wide bandwidth.

One technique for removing the residual power is to place a ring of absorbing material at the truncated edge of the spiral outside the radiation zone. This scheme allows the absorption of the residual power which would radiate in "negative" modes, which cause deterioration of the radiation patterns, especially their axial ratio. This scheme is shown in FIGS. 1 and 2A by the provision of the loading ring 33.

Performance tests were conducted for a configuration similar to that shown in FIG. 1, except that the spiral was Archimedean as shown in FIG. 7, with a separation between the arms of about 1.9 lines per inch. The experimental results demonstrate that for a spacing d (standoff distance) of 0.145 inch, the impedence band is very broad—more than 20:1 for a VSWR below 2:1. The band ends depend on the inner and outer terminating radii of the spiral. The feed was a broadband balun made from a 0.141 inch semi-rigid coaxial cable, which made a feed radius of 0.042 inch. It was necessary to create a narrow aperture in the ground plane in order to clear the balun. The cavity's radius was 0.20 inch, and its depth 2 inches. This aperture also affects the high frequency performance.

Other tests were performed using a log-spiral (equiangular spiral) 0.3 inch above a similar ground plane and balun. Both spirals, incidentally, were "complementary geometries".

The diameter of each spiral (the Archimedean and the equiangular) was 3.0 inches, with foam absorbing material (loading) extending from 1.25 to 1.75 inches from center. If this terminating absorber is effective enough, the antenna match can be extended far below the frequencies at which the spiral radiates significantly. More importantly, at the operating frequencies, the termination eliminates currents that would be reflected from the outer edge of the spiral and disrupt the desired pattern and polarization. These reflected waves are sometimes called "negative modes" because they are mainly polarized in the opposite sense to the desired mode. Thus, their primary effect is to increase the axial ratio of the patterns.

Figure 12:
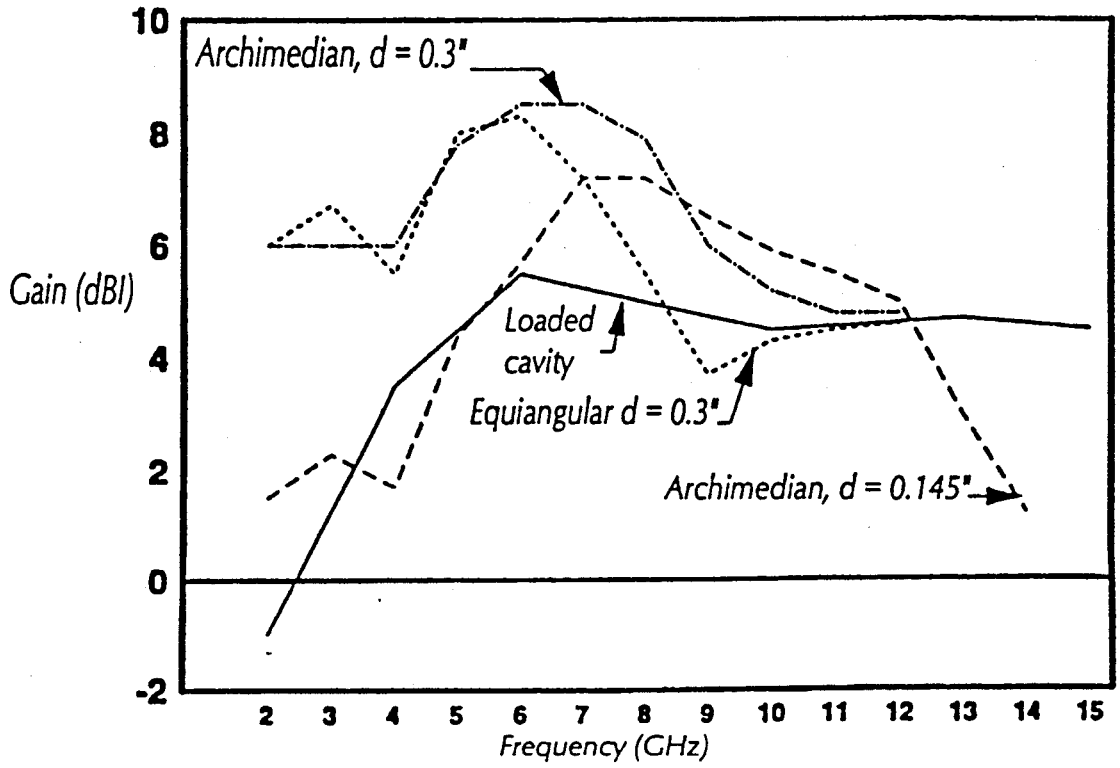
FIG. 12 is a graph of laboratory results comparing antennas according to the present invention with a prior cavity-loaded spiral antenna.

For an engineering model, the Archimedean and equiangular antennas operate well from 2 to 14 GHz, a 7:1 band. It is expected that the detailed engineering required to produce a commercial antenna would yield excellent performance over most of this range. The gain is higher than that of a 2.5" commercial lossy-cavity spiral antenna up through 12 GHz, as shown in FIG. 12. (We believe that the dip at 4 GHz is an anomaly.) The increased gain of antennas of the present invention over a lossy-cavity spiral antenna is in part attributable to the relative lack of loss of radiated power from the underside of the spiral mode antenna elements. The spiral mode antenna element radiates to both sides, with radiation from the underside passing through the dielectric backing and the dielectric substrate relatively undiminished. This radiation is reflected by the ground plane (sometimes more than once) and augments the radiation emanating from the upper side.

FIG. 12 also shows gain curves for a ground plane spacing of 0.3 inch. The Archimedean version of this design demonstrates a gain improvement over the nominal loaded-cavity level of 4.5 dBi (with matched polarization) over a 5:1 band. The gain of the 0.145 inch spaced antenna is lower because the substrate was a somewhat lossy cardboard material rather than a light foam used for the 0.3 inch example.

Figure 13:
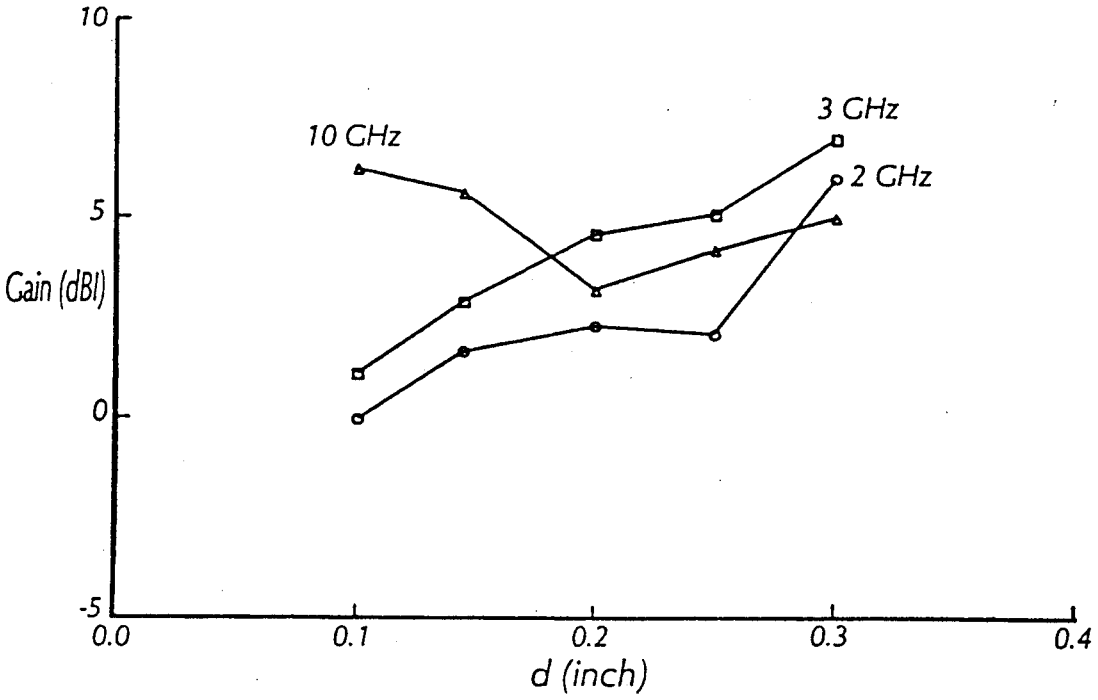
FIG. 13 is a graph of laboratory results for the antenna of FIG. 1 showing the effect of positioning the antenna element on antenna gain at various spacings from the ground plane for three different operating frequencies.

We have found that a decrease in thickness causes the band of high gain to move upwardly in frequency, subject to the limitation imposed by the inner truncation radius. FIG. 13 shows gain plotted at several frequencies as a function of spacing for a "substrate" of air. At low frequencies, the spiral arms act more like transmission lines than radiators as they are moved closer to the ground plane. They carry much of their energy into the absorber ring, and the gain decreases.

For these types of antennas, we have found that efficient radiation generally can take place even when the spacing is far below the quarter wave "optimum". We have observed a gain enhancement over that of a loaded cavity for frequencies that produce a spacing of less than 1/20 wavelength. If one is willing to tolerate gain degradation down to 0 dBi at the low frequencies, as found in most commercial spirals, the spacing can be as small as 1/60th wavelength.

We investigated several configurations of edge loading, most notably foam absorbing material and magnetic RAM (radar absorbing materials) materials. For the foam case, we compared log-spirals terminated with a simple circular truncation (open circuit) and terminated with a thin circular shorting ring. There was no discernable difference in performance. The magnetic RAM absorber was tried on open-circuit Archimedean and log-spirals with spacings of 0.09 and 0.3 inches. The results show that the magnetic RAM is not nearly so well-behaved as the foam. In addition to the gain loss caused by the VSWR spikes, the patterns showed a generally poor axial ratio, indicating that the magnetic RAM did not absorb as well as the foam. In our measurements, the loading materials were always shaped into a one-half-inch wide annulus, half within and half outside the spiral edge. The thickness was trimmed to fit between the spiral and the ground plane, and in the very close configurations it was mounted on top of the spiral.

This disclosure presents an analysis, supported by experiments, of a multioctave, frequency-independent or spiral-mode microstrip antenna according to the present invention. It shows that the spiral-mode structure is compatible with a ground plane backing, and thus explains why and how the spiral-mode microstrip antenna works.

It is shown herein, both theoretically and experimentally, that a high dielectric substrate has a disruptive effect on the radiation pattern, and therefore that a low-dielectric constant substrate is preferred in wideband microstrip antennas. This finding may explain why earlier attempts to develop a spiral microstrip antenna have generally failed. It is also shown herein experimentally that a conformally mounted spiral microstrip antenna can achieve a frequency bandwidth of 6:1 or so.

Figure 14:
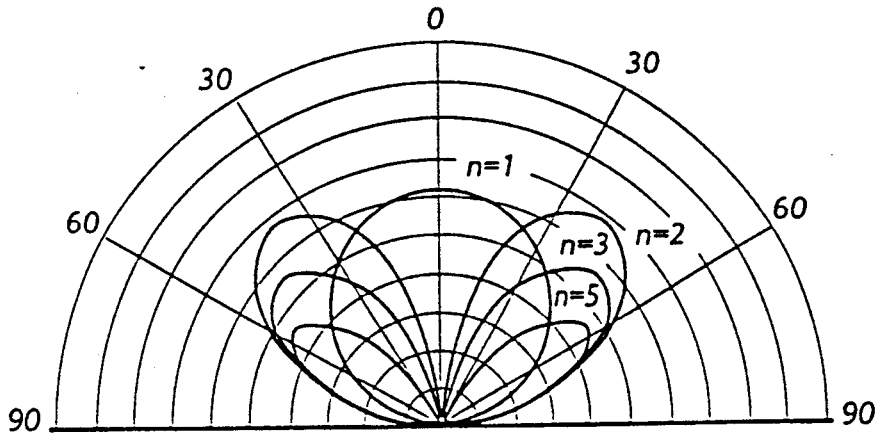
FIG. 14 is a graph of antenna radiation patterns, specifically, spiral mode patterns (for $n=1$, $n=2$, etc.).

"Spiral modes", as that term is used herein, refers to eigenmodes of radiation patterns for structures such as spiral and sinuous antennas. Indeed, each of the spiral, sinuous, log-periodic tooth, and "Greek spiral" (rectangular) antenna elements disclosed herein as examples of the present invention exhibit spiral modes. A "spiral-mode antenna element" is an antenna element that exhibits radiation modes similar to those of spiral antenna elements. A mode can be thought of as a characteristic manner of radiation. For example, FIG. 14 shows some typical spiral modes for a prior spiral antenna, and particularly shows modes n=1, n=2, n=3, and n=5. Here, the axis perpendicular to the plane of the antenna points to zero degrees in the figure. The "spiral mode" antenna elements disclosed herein as part of a microstrip antenna radiate in patterns roughly similar to, though not necessarily identical with, the patterns of FIG. 14. As shown in FIG. 14, the spiral mode radiation pattern for n=1 is apple-shaped and is preferred for many communication applications. In such applications, the donut-shaped higher order modes should be avoided to the extent possible (as by using only two spiral arms) or suppressed in some manner.

"Multioctave", as that term is used herein, refers to a bandwidth of greater than 100%. "Frequency-independent", as that term is used herein in connection with antenna elements and geometry patterns formed therein, refers to a geometry characterized by angles or a combination of angles and a logarithmically periodic dimension (excepting truncated portions), as described in R. H. Rumsey in *Frequency Independent Antennas*, supra.

To obtain near maximum gain at a given frequency, the stand-off distance d should be between 0.015 and 0.30 of a wavelength of the waveform in the substrate (the dielectric spacer). With regard to the relative dielectric constant of the substrate, applicants have found that materials with $\epsilon_r$ of between 1 and 4.37 work well, and that a range of 1.1 to 2.5 appears practical. A higher dielectric constant (5 to 20) leads to gradual narrowing of bandwidth and deterioration of performance which nevertheless may still be acceptable in many applications. This and other design configurations, which operate satisfactorily for a specific frequency range, can be changed so that the antenna will work satisfactorily in another frequency range of operation. In such cases the dimensions and dielectric constant of the design are changed by the well known "frequency scaling" technique in antenna theory.

While the invention has been disclosed in preferred forms by way of examples, it will be obvious to one skilled in the art that many modifications, additions, and deletions may be made therein without departing from the spirit and scope of the invention as set forth in the following claims.

We claim:

1. A microwave microstrip antenna comprising:

a conducting ground surface;

a spiral-mode antenna element having at least two arm portions, a peripheral portion, and feed points, said spiral mode antenna element being adapted to be excited at said feed points to generate at least one spiral mode, said antenna element being positioned such that it is generally parallel to and spaced apart from said conducting ground surface;

a substrate positioned between said antenna element and said conducting ground surface for spacing said antenna element a selected distance from said ground surface, said selected distance being between $0.02\lambda_c$ and $0.1\lambda_2$, where $\lambda_c$ is the wavelength at the geometric mean frequency between the minimum and maximum operating frequencies, said substrate having a low dielectric constant; and a loading material positioned adjacent said peripheral portion of said antenna element for improvement of axial ratio.

2. A microstrip antenna as claimed in claim 1 wherein said antenna element comprises a metal foil having a pattern formed therein.

3. A microstrip antenna as claimed in claim 2 wherein said pattern is sinuous.

4. A microstrip antenna as claimed in claim 2 wherein said pattern is log-periodic.

5. A microstrip antenna as claimed in claim 4 wherein said pattern is generally toothed.

6. A microstrip antenna as claimed in claim 2 wherein said pattern is generally spiral.

7. A microstrip antenna as claimed in claim 6 wherein said spiral pattern is Archimedean.

8. A microstrip antenna as claimed in claim 6 wherein said spiral pattern is equiangular.

9. A microstrip antenna as claimed in claim 2 wherein said spiral-mode antenna element has a geometry similar to that of one of the class of the planar frequency-independent antennas.

10. A microstrip antenna as claimed in claim 1 wherein said substrate has a relative dielectric constant of between 1.0 and 4.3.

11. A microstrip antenna as claimed in claim 1 wherein said substrate has a relative dielectric constant of between 1.1 and 2.5.

12. A microstrip antenna as claimed in claim 1 wherein said substrate is dimensioned so that said selected distance is between 0.06 and 0.3 inches for operating frequencies of between 2 GHz and 18 GHz.

13. A microstrip antenna as claimed in claim 1 wherein said substrate comprises a flexible foam.

14. A microstrip antenna as claimed in claim 1 wherein said loading material comprises carbon-impregnated foam.

15. A microstrip antenna as claimed in claim 1 wherein said ground surface is a surface of a structure.

16. A multioctave microstrip antenna for mounting to one side of a surface of a structure, comprising:

a conducting ground surface;

a spiral-mode antenna element including at least two metal foil arms formed in a geometric pattern and adapted to generate at least one spiral mode when excited, said antenna element being positioned generally parallel to and spaced apart from said conducting ground surface; and a substrate positioned between said antenna element and said conducting ground surface for spacing said antenna element a selected distance from said ground surface, said selected distance being between $0.02\lambda_c$ and $0.1\lambda_c$, where $\lambda_c$ is the wavelength at the arithmetic mean frequency between the minimum and maximum operating frequencies, said substrate having a dielectric constant of between 1.0 and 4.3.

17. A microstrip antenna as claimed in claim 16 further comprising a loading material positioned adjacent a peripheral portion of said antenna element.

18. A microstrip antenna as claimed in claim 16 wherein said geometric pattern is generally spiral-shaped.

* * * * *